US010512800B2

(12) United States Patent
Carillo

(10) Patent No.: US 10,512,800 B2
(45) Date of Patent: Dec. 24, 2019

(54) DOUBLE SIDED CONCRETE FALL ARREST ANCHOR

(71) Applicant: Jose Carillo, Elk Grove, CA (US)

(72) Inventor: Jose Carillo, Elk Grove, CA (US)

( * ) Notice: Subject to any disclaimer, the term of this patent is extended or adjusted under 35 U.S.C. 154(b) by 204 days.

(21) Appl. No.: 15/840,971

(22) Filed: Dec. 13, 2017

(65) Prior Publication Data

US 2019/0001166 A1 Jan. 3, 2019

Related U.S. Application Data

(60) Provisional application No. 62/433,411, filed on Dec. 13, 2016.

(51) Int. Cl.
*A62B 35/00* (2006.01)

(52) U.S. Cl.
CPC ..... *A62B 35/0068* (2013.01); *A62B 35/0043* (2013.01)

(58) Field of Classification Search
CPC ..... A62B 35/0068; A62B 35/0043
USPC ..... 248/499, 508; 52/125.4, 125.5, 223.13, 52/309.11, 426, 787.1
See application file for complete search history.

(56) References Cited

U.S. PATENT DOCUMENTS 4,408,940 A * 10/1983 Fischer ..... E04B 1/4164 248/679
5,644,889 A * 7/1997 Getz ..... E04G 23/0222 411/383
5,730,245 A * 3/1998 Conway ..... E04G 21/3276 182/3
6,024,330 A * 2/2000 Mroz ..... F16M 7/00 248/188.4
6,076,326 A * 6/2000 Gutelius, Jr. ..... E04H 9/02 52/698
9,476,525 B2 * 10/2016 Tarpy ..... F16L 9/04
10,384,085 B1 * 8/2019 Aleksovski ..... A62B 35/0068
2011/0083397 A1 * 4/2011 Zimmer ..... F16B 13/0858 52/699

* cited by examiner

*Primary Examiner* — Gwendolyn W Baxter
(74) *Attorney, Agent, or Firm* — Ruth Eure

(57) ABSTRACT

A fall arrest anchor for minimizing risk of falls and multiple configurations appropriate to different specific construction situations is provided. The fall arrest anchor comprises a dual anchor having an open first end and an open second end with the open first end being opposite the open second end. An amount of cast concrete completely encases the dual anchor between the first end and the second end. An upper fall arrest attachment is releasably securable within the open first end of the dual anchor. A lower fall arrest attachment is releasably securable within the open second end of the dual anchor. The dual anchor allows for sequential placement on a perimeter of elevated surfaces either as tie-offs or for holding static perimeter lines, mitigating risks of work on leading edges in general and on high rise roof tops with low parapet walls.

20 Claims, 6 Drawing Sheets

DOUBLE SIDED CONCRETE FALL ARREST ANCHOR

CLAIM OF PRIORITY

This patent application claims priority under 35 USC 119 (e) (1) from U.S. Provisional Patent Application Ser. No. 62/433,411 filed Dec. 13, 2016, of common inventorship herewith entitled, "Double Sided Concrete Fall Arrest Anchor" which is incorporated herein by reference as though the same were set forth in its entirety.

FIELD OF THE INVENTION

The present invention pertains to the field of a double sided concrete fall arrest anchor and, more particularly, the invention relates to a double sided fall arrest anchor featuring separate tie-off points to minimize risk of falls, and multiple configurations appropriate to different specific construction situations.

BACKGROUND OF THE INVENTION

It is widely known that in the building and construction industry in the United States, falls are the leading cause of worker fatalities. On average each year between 150 and 200 workers are killed, and a staggering number of more than 100,000 workers are injured as a result of falls occurring at such building and construction sites. OSHA, the federal government agency that oversees labor and industry standards, has come to recognize that accidents are generally complex events that commonly involve a variety of factors. As a consequence, the standard for fall protection deals with both the human and equipment-related components in designing and implementing standards for protecting workers from fall hazards.

For example, in order to insure the protection of workers it is recommended that both employers and employees implement the following steps or procedures: 1) where protection is required, select fall protection systems appropriate for that situation; 2) use proper construction and installation of safety systems; 3) supervise employees properly; 4) use safe work procedures; and 5) train workers in the proper selection, use, and maintenance of fall protection systems.

More importantly, OSHA has developed specific rules, procedures and systems designed to prevent workers from falling off, onto or through working levels, and to protect workers from being struck by falling objects. These performance-oriented requirements facilitate the ability of employers to provide the mandated protection. The systems and procedures cover most construction workers except those inspecting, investigating, or assessing workplace conditions prior to the actual start of work or after all work has been completed. Areas or activities where fall protection is needed include ramps, runways and other walkways, excavations, hoist areas, holes, formwork and reinforcing steel, leading edge work, unprotected sides and edges, overhand bricklaying and related work, roofing work, precast concrete erection, wall openings, residential construction and other walking/working surfaces.

Under the above rules, systems and procedures employers are able to select fall protection measures and equipment that are compatible with the type of work being performed and the particular work site. Thus, fall protection systems and equipment can be provided through the use of guardrail systems, safety net systems, personal fall arrest systems, positioning device systems, and warning line systems. While the aforementioned systems cover many situations, one critical problem is the current non-availability of any type of parapet-type safety and fall protection system that can be easily set up and attached to the wall surfaces of home or building structures that may be surrounded by uneven or un-level ground, especially uneven ground surrounding the eaves of the structure. It is often the case that a walkway is constructed on the site by carpenters using 2×4's and 2×6's that in many cases is the building material that should be used in the home construction, but is instead diverted to construct a hand-built, makeshift walkway prone to failure and accidents.

Despite the ingenuity of conventional systems and devices, there remains a need for a double sided fall arrest anchor featuring separate tie-off points to minimize risk of falls, and multiple configurations appropriate to different specific construction situations.

SUMMARY OF THE INVENTION

It is an object of the present invention to provide a double sided concrete fall arrest anchor support embedded in a support structure in concrete for two opposite fall arrest anchoring attachments for an elevated work area. The work area includes a deck station and/or a wall section for protecting simultaneously two end users from falling while working in precarious areas. The anchor assembly comprises a first end coil loop and a second end coil loop connected by intricate heavy wire loops. A first tie off device is mounted to the first end and a second tie off device is mounted to the second end of the anchor. Upon releasably securing the fall arrest attachment to the anchor, a worker is inhibited from falling.

The present invention is a fall arrest anchor for minimizing risk of falls and multiple configurations appropriate to different specific construction situations. The fall arrest anchor comprises a dual anchor having an open first end and an open second end with the open first end being opposite the open second end. An amount of cast concrete completely encases the dual anchor between the first end and the second end. An upper fall arrest attachment is releasably securable within the open first end of the dual anchor. A lower fall arrest attachment is releasably securable within the open second end of the dual anchor. The dual anchor allows for sequential placement on a perimeter of elevated surfaces either as tie-offs or for holding static perimeter lines, mitigating risks of work on leading edges in general and on high rise roof tops with low parapet walls.

In addition, the present invention is a method for minimizing risk of falls and multiple configurations appropriate to different specific construction situations. The method comprises providing a dual anchor having an open first end and an open second end with the open first end being opposite the open second end, completely encasing the dual anchor between the first end and the second end with an amount of cast concrete, releasably securing an upper fall arrest attachment within the open first end of the dual anchor, releasably securing a lower fall arrest attachment within the open second end of the dual anchor, and allowing for sequential placement on a perimeter of elevated surfaces either as tie-offs or for holding static perimeter lines, mitigating risks of work on leading edges in general and on high rise roof tops with low parapet walls.

The present invention further includes a fall arrest anchor for minimizing risk of falls and multiple configurations appropriate to different specific construction situations. The fall arrest anchor comprises a dual anchor having an open first end and an open second end with the open first end being opposite and offset from the open second end. An amount of cast concrete completely encases the dual anchor between the first end and the second end. An upper fall arrest attachment is releasably securable within the open first end of the dual anchor. A lower fall arrest attachment is releasably securable within the open second end of the dual anchor. An upper coil plug is alternatingly releasably receivable within the open first end of the dual anchor upon removal of the upper fall arrest attachment. A lower coil plug is alternatingly releasably receivable within the open second end of the dual anchor upon removal of the lower fall arrest attachment. The dual anchor allows for sequential placement on a perimeter of elevated surfaces either as tie-offs or for holding static perimeter lines, mitigating risks of work on leading edges in general and on high rise roof tops with low parapet walls.

DETAILED DESCRIPTION OF THE INVENTION

The present invention, hereafter referred to as Double Sided Concrete Fall Arrest Anchor, indicated generally at 27, is a uniquely designed concrete anchor featuring separate tie-off points to minimize risk of falls, and multiple configurations appropriate to different specific construction situations. Additionally, use of Double Sided Concrete Fall Arrest Anchor 27 obviates the need to drill into cast concrete, providing superior compatibility with modern concrete technologies.

Figure 1:
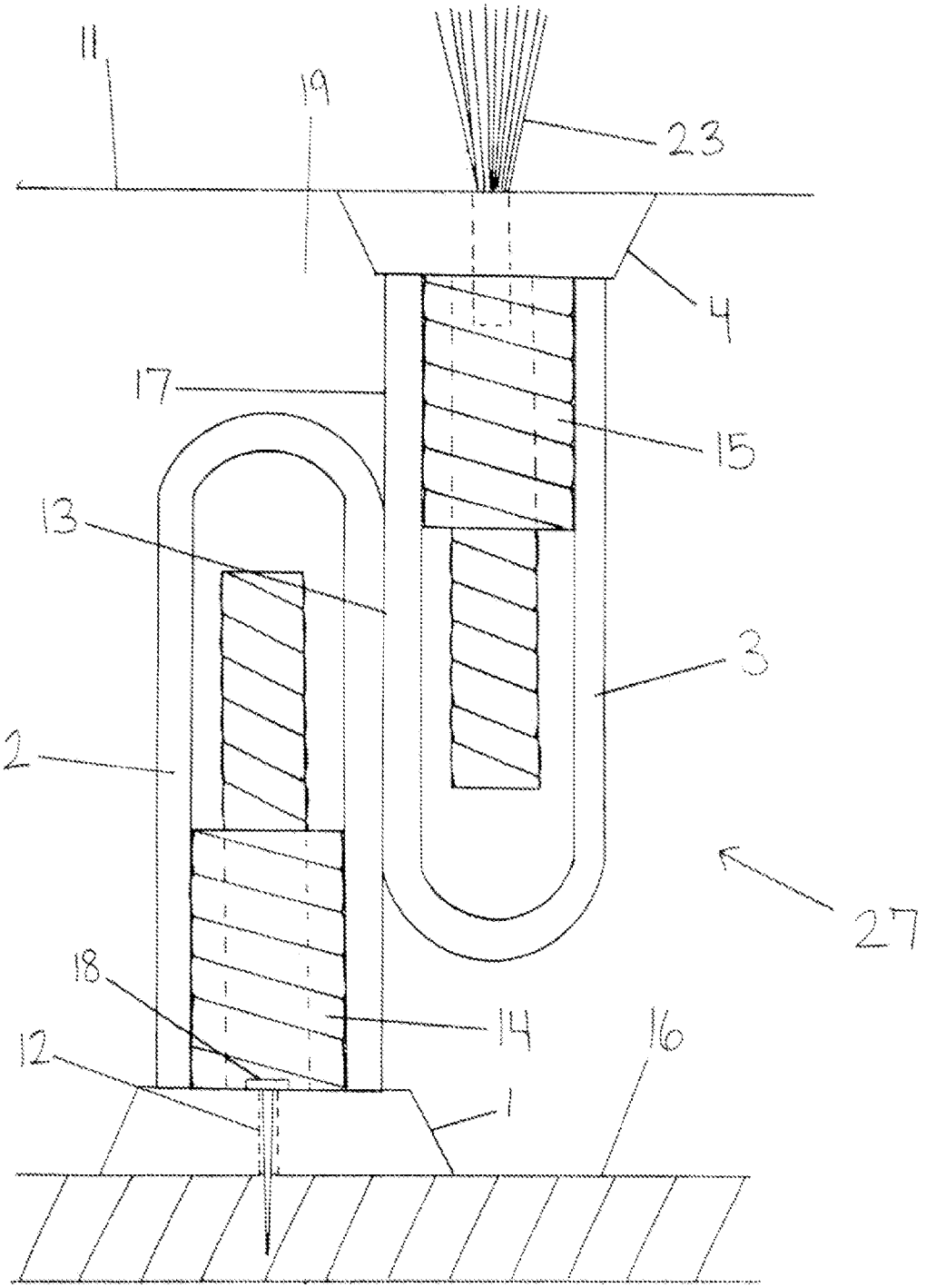
FIG. 1 is an elevational sectional illustrating a double sided concrete fall arrest anchor, constructed in accordance with the present invention.
Figure 2:
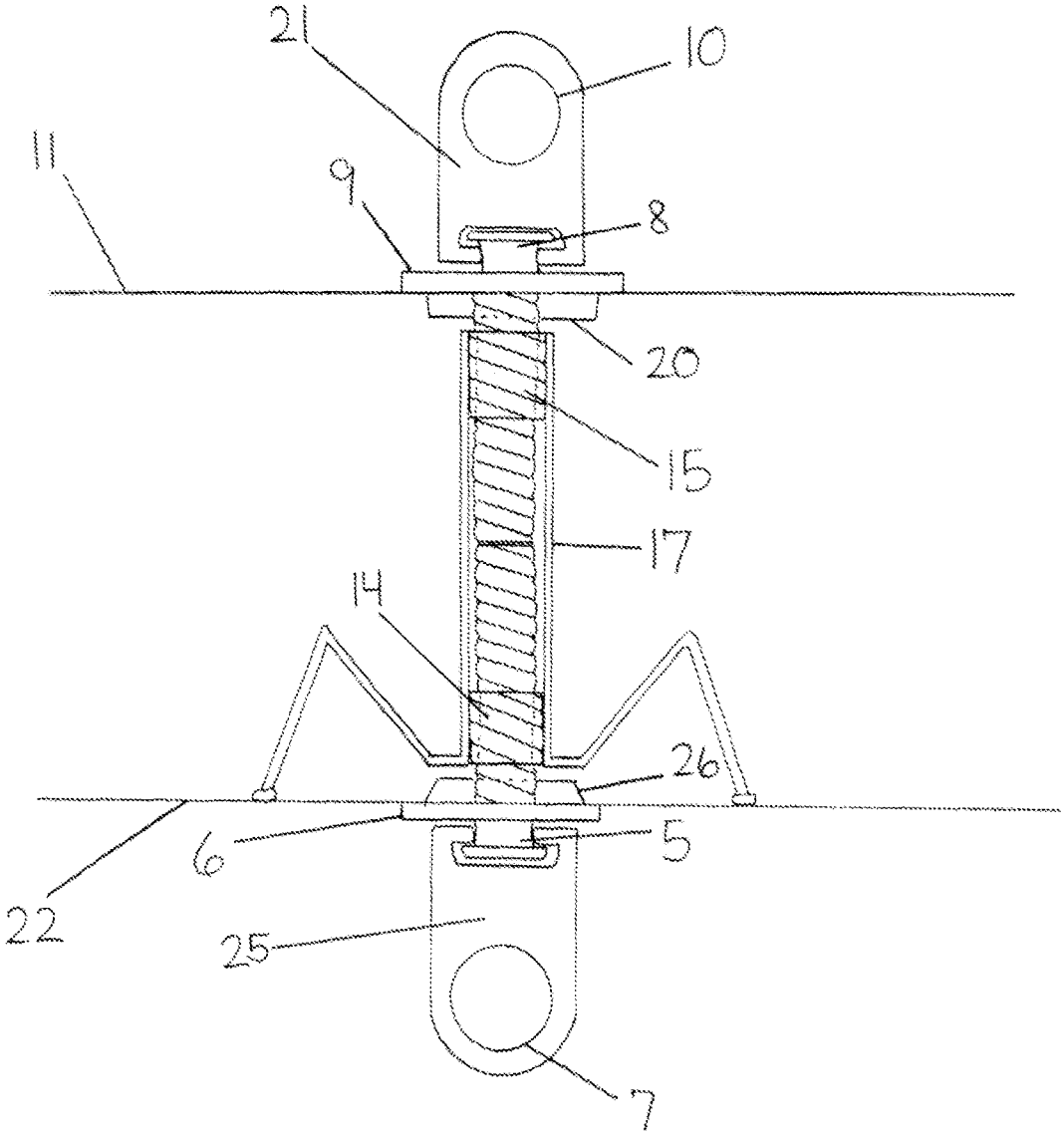
FIG. 2 is another elevational sectional view illustrating the double sided concrete fall arrest anchor, constructed in accordance with the present invention.
Figure 3:
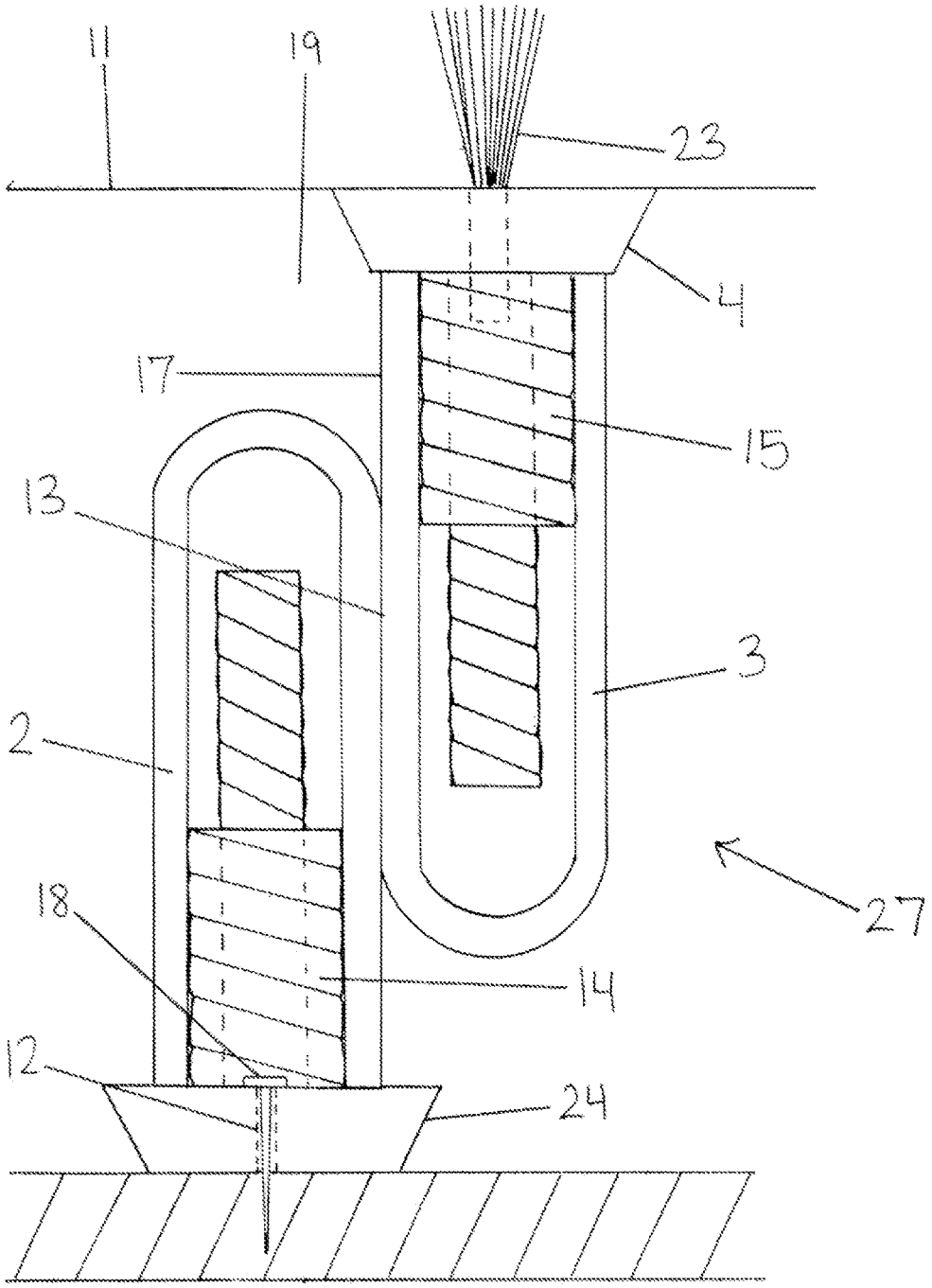
FIG. 3 is still another elevational sectional view illustrating the double sided concrete fall arrest anchor, constructed in accordance with the present invention.
Figure 4:
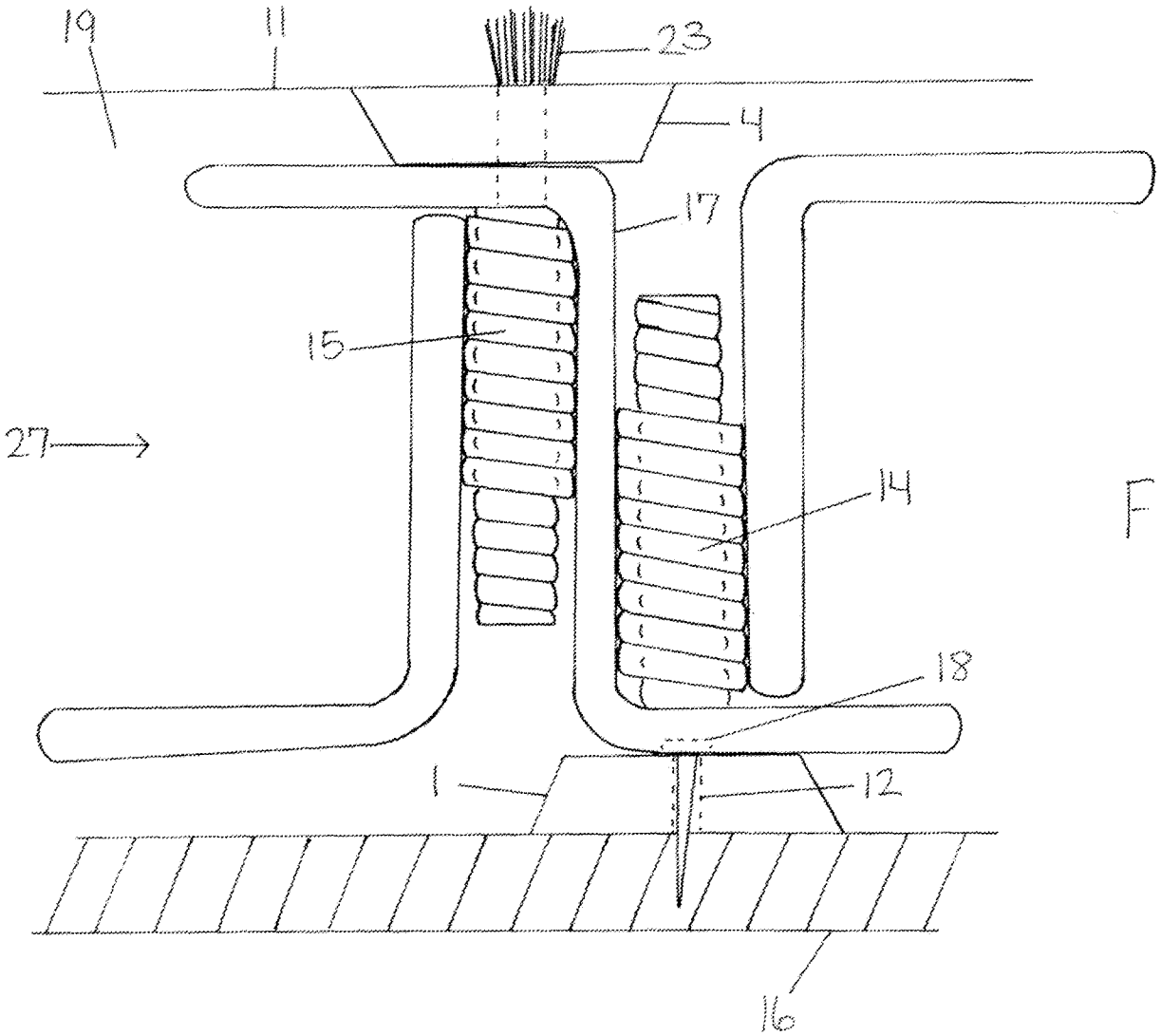
FIG. 4 is an elevational sectional view illustrating another embodiment of the double sided concrete fall arrest anchor, constructed in accordance with the present invention, with a lower plug nailed to decking and the upper plug having plug locator whiskers.
Figure 5:
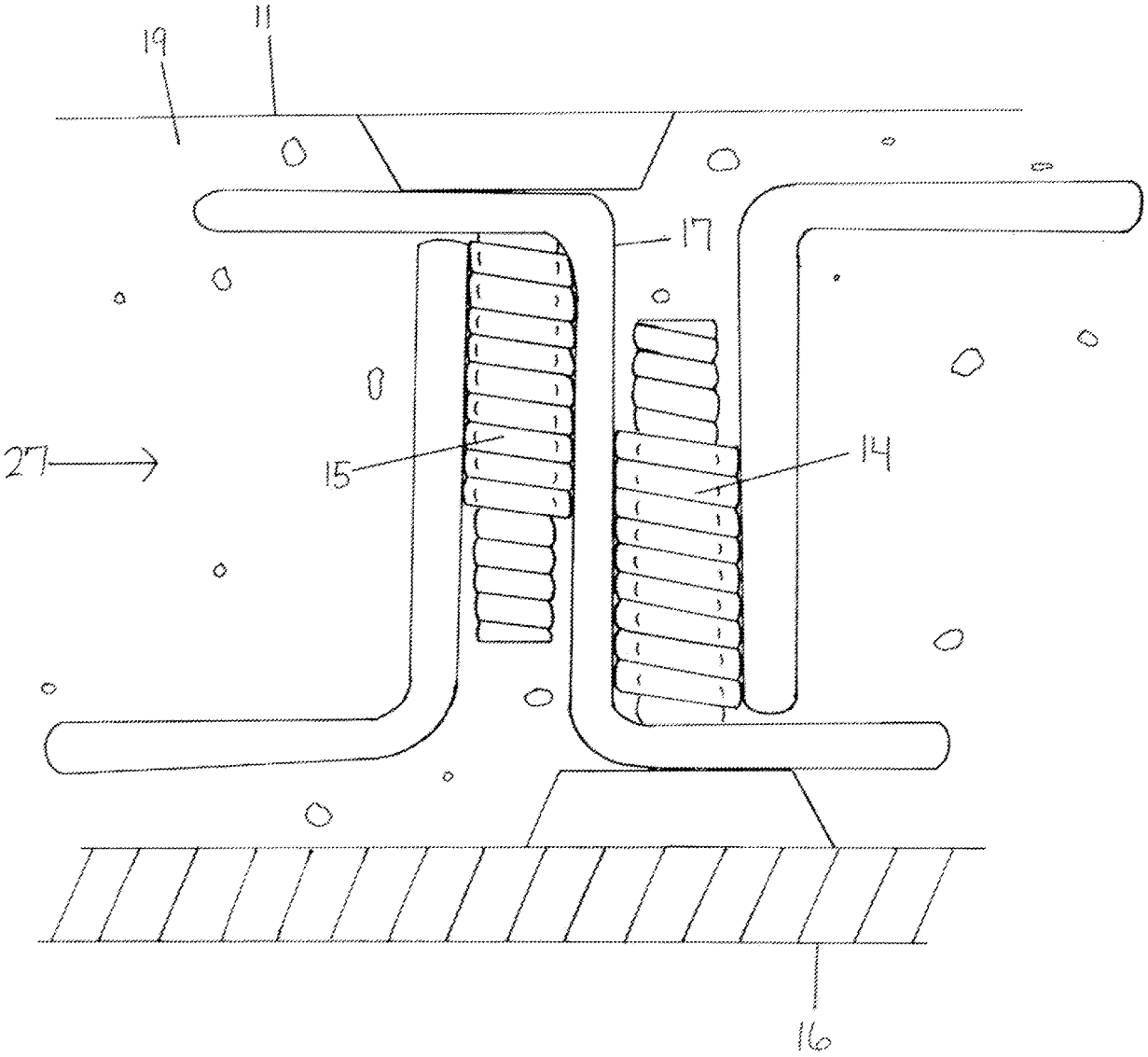
FIG. 5 is another elevational sectional view illustrating the double side concrete fall arrest anchor of FIG. 4, constructed in accordance with the present invention, with the anchor embedded in concrete and the upper plug removed.
Figure 6:
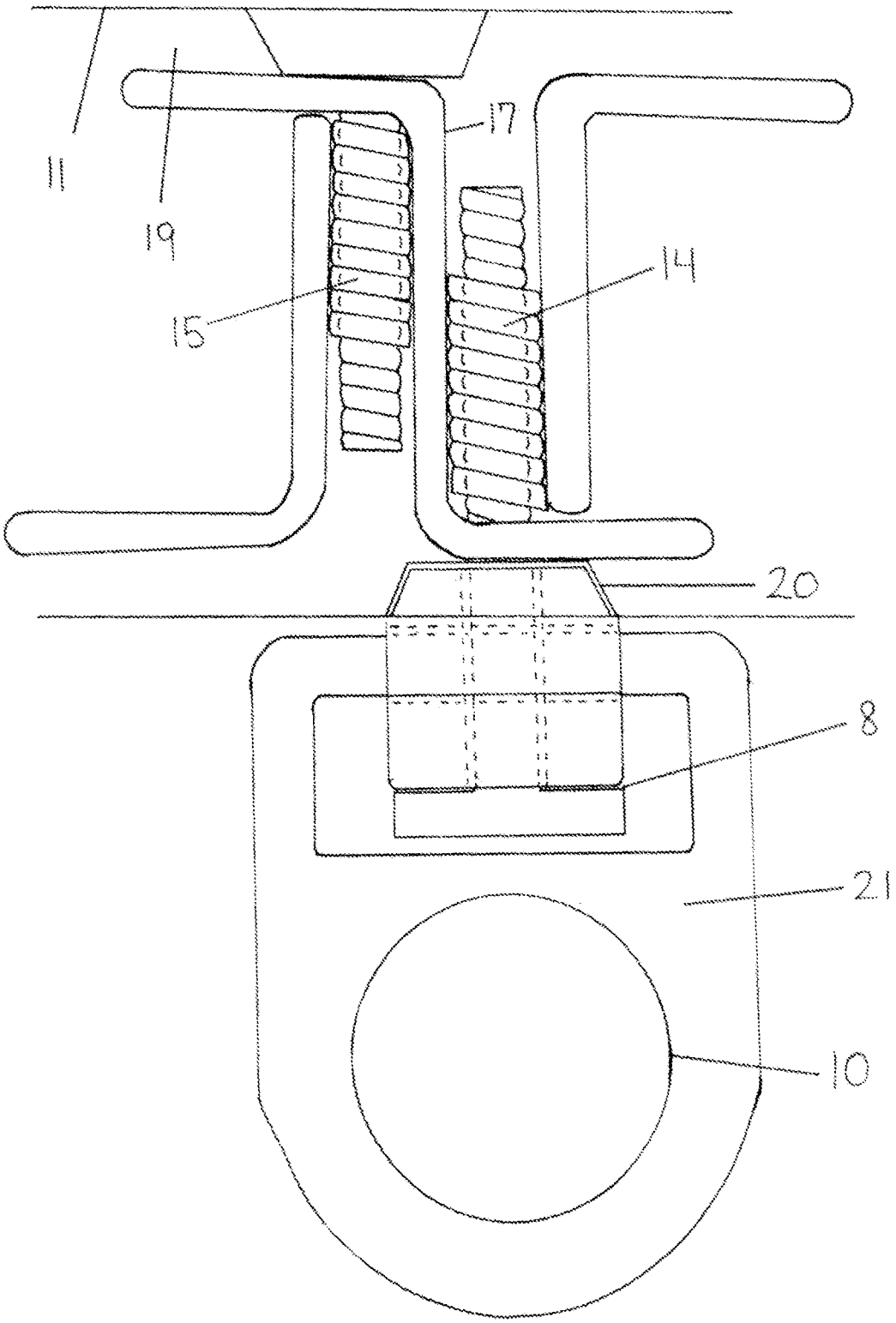
FIG. 6 is still another elevational sectional view illustrating the double side concrete fall arrest anchor of FIG. 4, constructed in accordance with the present invention, with the anchor embedded in concrete, the upper plug removed, the lower plug removed, and the fall arrest attachment fastened to inverted coils.

In a primary embodiment shown in FIG. 1, Double Sided Concrete Fall Arrest Anchor 27 consists of a Lower Coil Plug 1 fastened by a Nail or Screw 18 inserted through Lower Coil Plug Nail Hole 12 into Decking 16, onto which a Lower Coil Loop Anchor 2 is threaded by means of Lower Coil Loop Threads 14. Upper Coil Plug 4 is positioned above Lower Coil Plug 1. Upper Coil Plug 4 is inserted onto Upper Coil Loop Threads 15. By pouring Concrete 19 onto Decking 16, the Dual Anchor 17 of Lower Coil Plug 1 and Upper Coil Plug 4 is securely embedded. In an alternate embodiment shown in FIG. 3, Double Concrete Fall Arrest Anchor 27 is fitted with a Non-Removable Lower Coil Plug 24, but is otherwise the same as previous embodiment shown in FIG. 1.

After allowing adequate time for Concrete 19 to cure and reach maximum strength, Upper Coil Plug 4 is removed by simply unthreading from Upper Coil Threads 15, thus forming an Upper Concrete Cavity 20 containing Upper Coil Loop Threads 15. This allows for the insertion of Upper Threading Bolt 8 through Upper Coil Loop Threads 15 into Dual Anchor 17, until Upper Base Plate 9 is flush with Upper Concrete Surface 11. Attaching Upper Swivel Pivotal D-ring 10 to Upper Threading Bolt 8 constitutes an Upper Fall Arrest Attachment 21, which is immediately ready for use. When not in use, Upper Fall Arrest Attachment 21 can be removed and Upper Coil Threads 15 can again be capped with Upper Coil Plug 4, with Upper Coil Plug Locator 23 providing ease of visual location and identification. Removal of Upper Fall Arrest Attachment 21 and/or Upper Threading Bolt 8 also eliminates tripping hazards, providing enhanced site safety.

Additionally, removing Decking 16 exposes Lower Concrete Surface 22 and Lower Coil Plug 1. Unthreading Lower Coil Plug 1 from Lower Coil Loop Threads 14 forms Lower Concrete Cavity 26, containing Lower Coil Loop Threads 14. This allows for the insertion of Lower Threading Bolt 5 through Lower Coil Loops Threads 14 into Dual Anchor 17, until Lower Base Plate 6 is flush with Lower Concrete Surface 22. Attaching Lower Swivel Pivotal D-ring 7 onto Lower Threading Bolt 5 constitutes a Lower Fall Arrest Attachment 25, which is immediately ready for use.

Both Upper Fall Arrest Attachment 21 and Lower Fall Arrest Attachment 25 provide support for loads up to 5000-lb in compliance with OSHA rules, and, owing to the design of Dual Anchor 17, each Double Sided Concrete Fall Arrest Anchor 27 is capable of providing such support on both sides of walls or floors simultaneously. Moreover, functionality of Double Sided Concrete Fall Arrest Anchor is unimpaired by various arrangements of Upper Coil Loops Threads 15 and Lower Coil Loop Threads 34 in relation to Upper Coil Lower Coil Union 13.

Furthermore, the various elements of Double Sided Concrete Fall Arrest Anchor 27 can be employed to accomplish a variety of purposes beyond serving as a tie-off point for multiple personnel. Both Upper Coil Loop Threads 15 and Lower Coil Loop Threads 14 can be used to support and harness surface thread-mounted guardrail anchor posts, or to mount threaded flag poles and banners, thread-mounted seating in various venues, thread-mounted traffic signs, as well as thread-mounted removable bollards. When employing Upper Swivel Pivotal D-ring 10 or Lower Swivel Pivotal D-ring 7, Upper Threading Bolt 8 and Lower Threading Bolt 5 can be used to support guideline cables for balancing steel columns during construction. Additionally, Upper Coil Loop Threads 15 and Lower Coil Loop Threads 14, in whole or in part, can be configured with mechanical threads to achieve higher yields in the support of surface-mounted equipment or overhead-mounted equipment. Components of the present invention are compatible with such additions as hollow sleeves, rubber washers and gaskets, expanded coil inserts, flared loop coil inserts, straight coil loop inserts, flared thin slab coil inserts, brace inserts, inverted wall brace inserts, and single and double pickup inserts while performing a similar or identical function.

Thus, the indicated range of applications of Double Sided Concrete Fall Arrest Anchor 27 makes it a uniquely advantageous addition to a wide variety of construction industry settings. It is suitable for the most commonly recommended direct overhead tie-off placement, while also allowing for sequential placement on the perimeter of elevated surfaces either as tie-offs or for holding static perimeter lines, mitigating the risks of work on leading edges in general and on high rise roof tops with low parapet walls specifically. Similarly, easy and secure temporary placement of signage and bollards allows Double Sided Concrete Fall Arrest Anchor 27 to vitally enhance security and safety, as well as efficiency, of construction personnel on roadside sites. Other uses include, but are not limited to, securing aircraft on hospital rooftop helipads during heavy winds and weather, as well as naval aircraft on various vessels and aircraft carriers when not in use or in rough seas.

Although this invention has been described with respect to specific embodiments, it is not intended to be limited thereto and various modifications which will become apparent to the person of ordinary skill in the art are intended to fall within the spirit and scope of the invention as described herein taken in conjunction with the accompanying drawings and the appended claims.

The invention claimed is:

1. A fall arrest anchor for minimizing risk of falls and multiple configurations appropriate to different specific construction situations, the fall arrest anchor comprising:

a dual anchor having an open first end and an open second end, the open first end being opposite the open second end;

an amount of cast concrete completely encasing the dual anchor between the first end and the second end;

an upper fall arrest attachment releasably securable within the open first end of the dual anchor; and a lower fall arrest attachment releasably securable within the open second end of the dual anchor;

wherein the dual anchor allows for sequential placement on a perimeter of elevated surfaces either as tie-offs or for holding static perimeter lines, mitigating risks of work on leading edges in general and on high rise roof tops with low parapet walls.

2. The fall arrest anchor of claim 1 wherein the dual anchor has an upper coil loop opening in a general upward direction and a lower coil loop opening in a general downward direction, the open first end formed in the opening of the upper coil loop, the open second end formed in the opening of the lower coil loop.

3. The fall arrest anchor of claim 2 wherein the upper coil loop is secured to the lower coil loop.

4. The fall arrest anchor of claim 1 and further comprising:

an upper coil plug alternatingly releasably receivable within the open first end of the dual anchor upon removal of the upper fall arrest attachment; and a lower coil plug alternatingly releasably receivable within the open second end of the dual anchor upon removal of the lower fall arrest attachment.

5. The fall arrest anchor of claim 4 wherein the upper coil plug is threadably receivable within the open first end and the lower coil plug is threadably receivable within the second open end.

6. The fall arrest anchor of claim 4 wherein an upper surface of the upper coil plug is flush with a top surface of the cast concrete and a lower surface of the lower coil plug is flush with a bottom surface of the cast concrete.

7. The fall arrest anchor of claim 4 wherein the upper coil plug has an upper coil plug locator providing ease of visual location and identification.

8. The fall arrest anchor of claim 1 wherein the upper fall arrest attachment has an upper threading bolt threadable into the open first end of the dual anchor, an upper swivel pivotal D-ring attached to the upper threading bolt and the lower fall arrest attachment has a lower threading bolt threadable into the open second end of the dual anchor, a lower swivel pivotal D-ring attached to the lower threading bolt.

9. The fall arrest anchor of claim 1 wherein the upper fall arrest attachment and the lower fall arrest attachment provides support on both sides of walls or floors simultaneously.

10. The fall arrest anchor of claim 1 wherein the first open end is offset from the second open end.

11. The fall arrest anchor of claim 1 wherein the first open end is aligned with the second open end.

12. A method for minimizing risk of falls and multiple configurations appropriate to different specific construction situations, the method comprising:

providing a dual anchor having an open first end and an open second end, the open first end being opposite the open second end;

completely encasing the dual anchor between the first end and the second end with an amount of cast concrete;

releasably securing an upper fall arrest attachment within the open first end of the dual anchor;

releasably securing a lower fall arrest attachment within the open second end of the dual anchor; and allowing for sequential placement on a perimeter of elevated surfaces either as tie-offs or for holding static perimeter lines, mitigating risks of work on leading edges in general and on high rise roof tops with low parapet walls.

13. The method of claim 12 and further comprising:

removing the upper fall arrest attachment;

removing the lower fall arrest attachment;

releasably securing an upper coil plug within the open first end of the dual anchor; and releasably securing a lower coil plug within the open second end of the dual anchor.

14. A fall arrest anchor for minimizing risk of falls and multiple configurations appropriate to different specific construction situations, the fall arrest anchor comprising:

a dual anchor having an open first end and an open second end, the open first end being opposite and offset from the open second end;

an amount of cast concrete completely encasing the dual anchor between the first end and the second end;

an upper fall arrest attachment releasably securable within the open first end of the dual anchor;

a lower fall arrest attachment releasably securable within the open second end of the dual anchor;

an upper coil plug alternatingly releasably receivable within the open first end of the dual anchor upon removal of the upper fall arrest attachment; and a lower coil plug alternatingly releasably receivable within the open second end of the dual anchor upon removal of the lower fall arrest attachment;

wherein the dual anchor allows for sequential placement on a perimeter of elevated surfaces either as tie-offs or for holding static perimeter lines, mitigating risks of work on leading edges in general and on high rise roof tops with low parapet walls.

15. The fall arrest anchor of claim 14 wherein the dual anchor has an upper coil loop opening in a general upward direction and a lower coil loop opening in a general downward direction, the open first end formed in the opening of the upper coil loop, the open second end formed in the opening of the lower coil loop.

16. The fall arrest anchor of claim 14 wherein the upper coil plug is threadably receivable within the open first end and the lower coil plug is threadably receivable thin the second open end.

17. The fall arrest anchor of claim 14 wherein an upper surface of the upper coil plug is flush with a top surface of the cast concrete and a lower surface of the lower coil plug is flush with a bottom surface of the cast concrete.

18. The fall arrest anchor of claim 14 wherein the upper coil plug has an upper coil plug locator providing ease of visual location and identification.

19. The fall arrest anchor of claim 14 wherein the upper fall arrest attachment has an upper threading bolt threadable into the open first end of the dual anchor, an upper swivel pivotal D-ring attached to the upper threading bolt and the lower fall arrest attachment has a lower threading bolt threadable into the open second end of the dual anchor, a lower swivel pivotal D-ring attached to the lower threading bolt.

20. The fall arrest anchor of claim 14 wherein the upper fall arrest attachment and the lower fall arrest attachment provides support on both sides of walls or floors simultaneously.

* * * * *